United States Patent [19]

Giarrocco, III et al.

[11] Patent Number: 5,005,801

[45] Date of Patent: Apr. 9, 1991

[54] JACK HANGING APPARATUS

[76] Inventors: Martin A. Giarrocco, III, 7155 Stockley Rd., Upper Darby, Pa. 19082; Kevin J. McCarthy, 2061 Granite St., Philadelphia, Pa. 19124

[21] Appl. No.: 395,895

[22] Filed: Aug. 18, 1989

[51] Int. Cl.[5] ..... E04G 17/18

[52] U.S. Cl. ..... 249/211; 29/240; 29/281.1; 29/281.5; 249/23; 249/219.1; 269/43; 269/45; 269/904

[58] Field of Search ..... 249/23–25, 249/211, 219.1, 219.2; 29/240, 243.5, 281.1, 281.4, 281.5, 468, 464; 269/37, 40, 41, 43, 45, 904

[56] References Cited

U.S. PATENT DOCUMENTS

| | | | |
|---|---|---|---|
| 854,098 | 5/1907 | Mann | 249/23 |
| 3,185,433 | 5/1965 | Mueller | 249/219.2 |
| 3,782,675 | 1/1974 | Boll et al. | 249/23 |
| 3,782,676 | 1/1974 | Boll et al. | 249/23 |
| 3,806,074 | 4/1974 | Ward | 249/23 |
| 3,837,060 | 9/1974 | Stehling | 269/904 |
| 3,861,634 | 1/1975 | Hood et al. | 249/23 |
| 3,974,995 | 8/1976 | Blonde | 249/13 |
| 4,253,649 | 3/1981 | Hewson | 269/45 |
| 4,500,077 | 2/1985 | Coxon | 269/45 |
| 4,660,800 | 4/1987 | Horstketter | 249/211 |
| 4,826,390 | 5/1989 | Paxton | 269/904 |

FOREIGN PATENT DOCUMENTS

| | | | |
|---|---|---|---|
| 2557241 | 6/1977 | Fed. Rep. of Germany | 249/211 |

*Primary Examiner*—James C. Housel

*Attorney, Agent, or Firm*—Dann, Dorfman, Herrell and Skillman

[57] ABSTRACT

An apparatus and a method for holding, rotating and positioning a jack for the purpose of attaching said jack to one side of a structural support. The apparatus comprises a base and a holder. The base has a device to mount the base on the structural support. The holder is pivotally connected at one end to the base for displacement between a first location above said structural support and a second location at said one side. The holder has a receiver operable in a closed position to retain the jack as the holder is pivoted between said locations in order to position the jack for attachment to said one side of the structural support. The receiver is actuatable to an open position for removal of the holder from the jack after said attachment. The holder is displaceable from said second location back to said first location for removal of the apparatus from the support.

26 Claims, 7 Drawing Sheets

JACK HANGING APPARATUS

FIELD OF INVENTION

This invention relates to heavy construction, and more specifically to an apparatus and a method for holding, rotating and positioning a jack for attaching the jack to a structural support such as a steel or concrete beam or to a wall.

BACKGROUND OF THE INVENTION

In heavy construction, in creating supports between beams or walls for platforms or in pouring concrete structures, it is a common practice to use jacks to support the platforms of the forms or molds used in pouring concrete. In the case of creating concrete structures, the jacks are temporarily secured to steel or concrete beams, or to upright walls so as to provide a support for positioning the concrete forms so that they project beyond the beams or walls. After the jacks are mounted in place, the forms are supported on the jacks and the concrete is poured into the forms. After the concrete has set, the forms and the jacks may be removed so that the forms may be stripped from the poured concrete structures.

To facilitate removal of the jacks and the forms from the poured structures, the jacks are conventionally secured by a single rod which is anchored to the top of the beam or wall in an area which is accessible after the concrete is poured. When the jacks are mounted on the walls at a location removed from the exposed top, the jacks are commonly mounted by fasteners in the form of rods or bolts which pass into the wall and are anchored by nuts or other fasteners.

A typical jack is a triangular assembly having a top portion which extends horizontally from the support structure with an angularly extending strut portion which angles downwardly to provide vertical support, cantilever fashion, for the jack against the wall. The angular struts may be adjustable to accommodate to the various configurations which are necessary to provide the proper support for the cement forms used in the particular construction.

Although jacks are frequently constructed out of steel or another metal, it is not uncommon for jacks to be fabricated out of wood. Jacks may also be constructed from plastic materials or from any other type of material of sufficient strength to allow the jack to be used for the aforementioned functions.

Typically, the horizontal portion of the jack has a wooden plank attached to it for supporting the concrete forms. The wooden plank is often longer than the horizontal portion of the jack. The jack is typically in excess of four feet in length and may weigh over eighty pounds. Prior to the present invention, jacks were installed on the beam by a three-person crew, one person suspending the jack into the proper position adjoining the beam. The other two crew people are needed since it normally takes two people to make the attachments for securing the jack in place, particularly if the jack is positioned at some distance below the level of the beam or other support where there is a safe foothold.

Jacks are attached in sufficient quantity alongside and between parallel beams or other supports so that the planks provide a support on which to form a surface between said beams. A layer of concrete may be poured into forms resting on said surface or on a wooden platform resting on said surface, the concrete being set to create a deck alongside or between the beams. After the concrete has set, the jacks and any forms are removed.

This process of attaching jacks is hazardous and physically taxing on the crew because of the jack's bulk and weight, the adverse weather conditions that are frequently encountered in such outdoor work, and the height at which this process is often carried out. It is also an inefficient process as a jack is often not attached properly and has to be adjusted.

DESCRIPTION OF RELATED ART

U.S. Pat. Nos. 3,782,675 and 3,782,676 each disclose a concrete supporting form and hangers for supporting such forms from structural elements such as I-beams. U.S. Pat. No. 3,806,074 discloses means and techniques for mounting load supporting members on beams and the like, including the attachment of a load supporting member to a rod that is connected to an I-beam. U.S. Pat. No. 3,974,995 discloses a method of forming part of the outside wall of a building and the outside wall formed. U.S. Pat. No. 854,098 discloses a concrete wall form for houses.

SUMMARY OF THE INVENTION

It is an object of the invention to provide an apparatus to attach jacks that replaces the manual method currently used and eliminates the dangers and inefficiencies inherent in said manual method.

The invention comprises an apparatus and method for using said apparatus for holding, rotating and positioning a jack for the purpose of attaching said jack to one side of a structural support such as a steel or concrete beam or to a wall such as a retaining wall.

The apparatus comprises a base and holder. The base has means for temporarily mounting the base on a structural support such as a steel or concrete beam or on a wall or on a deck mounted on a beam or wall, so that the holder may be used to mount a series of jacks on the support, one after the other.

The holder is pivotally connected to the base for displacement between a first location above said structural support and a second location at said one side. The holder has a receiver operable in an engaged position to retain the jack as the holder is pivoted between said locations in order to position the jack for attachment to said one side of the structural support. The receiver is actuatable to a disengaged position for removal of the holder from the jack after said attachment. In said disengaged position, the holder is displaceable from the second location back to the first location, so that the base may be moved along the support to mount the next jack in the series.

In a preferred form, the holder is adjustable to provide accurate positioning of the jack at the desired vertical distance below the base to assure that the jacks in the series are horizontally aligned at the desired elevation along the side of the support.

BRIEF DESCRIPTION OF DRAWINGS

These and other objects of the invention will be set forth in more detail in the following description when read in conjunction with the drawings, in which.

DETAILED DESCRIPTION OF THE DRAWINGS

Figure 1:
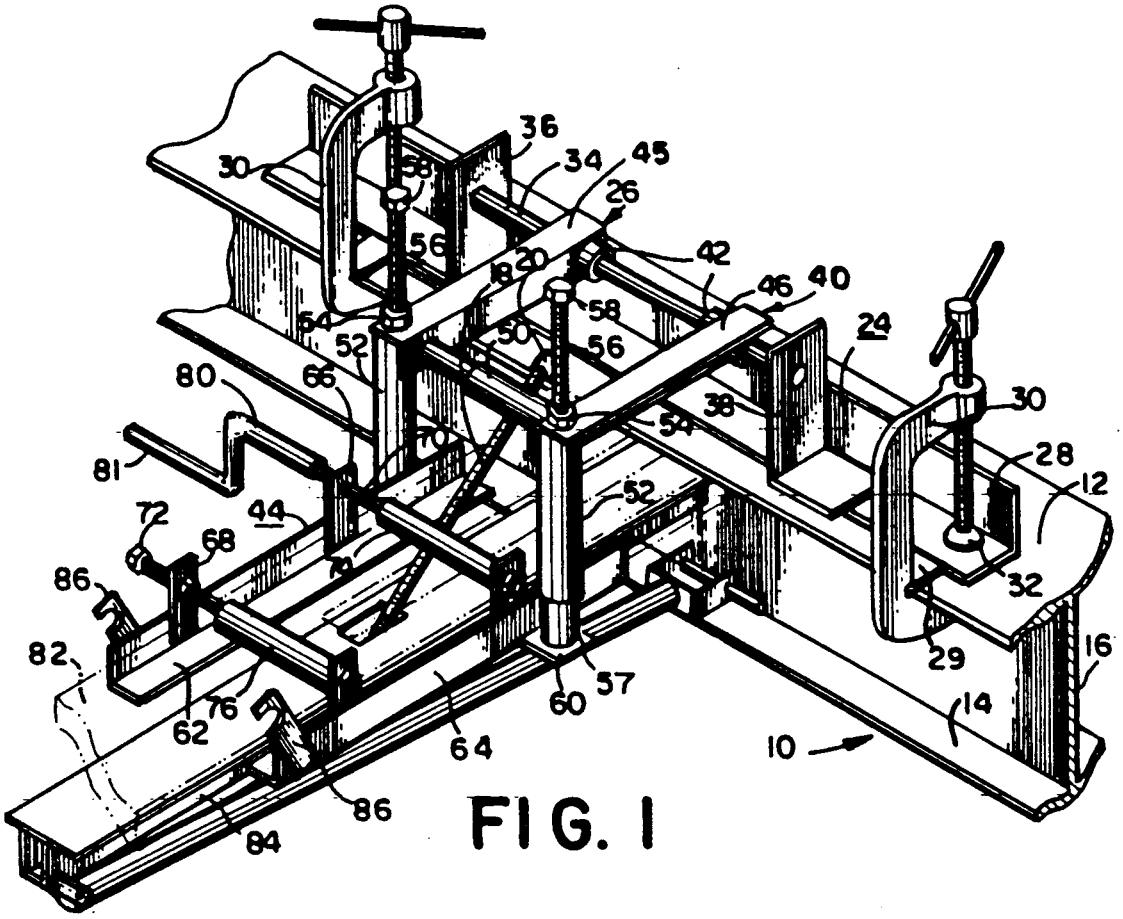
FIG. 1 is a view in perspective of the apparatus mounted on a steel beam, showing the jack in phantom lines at one side of the beam.
Figure 4:
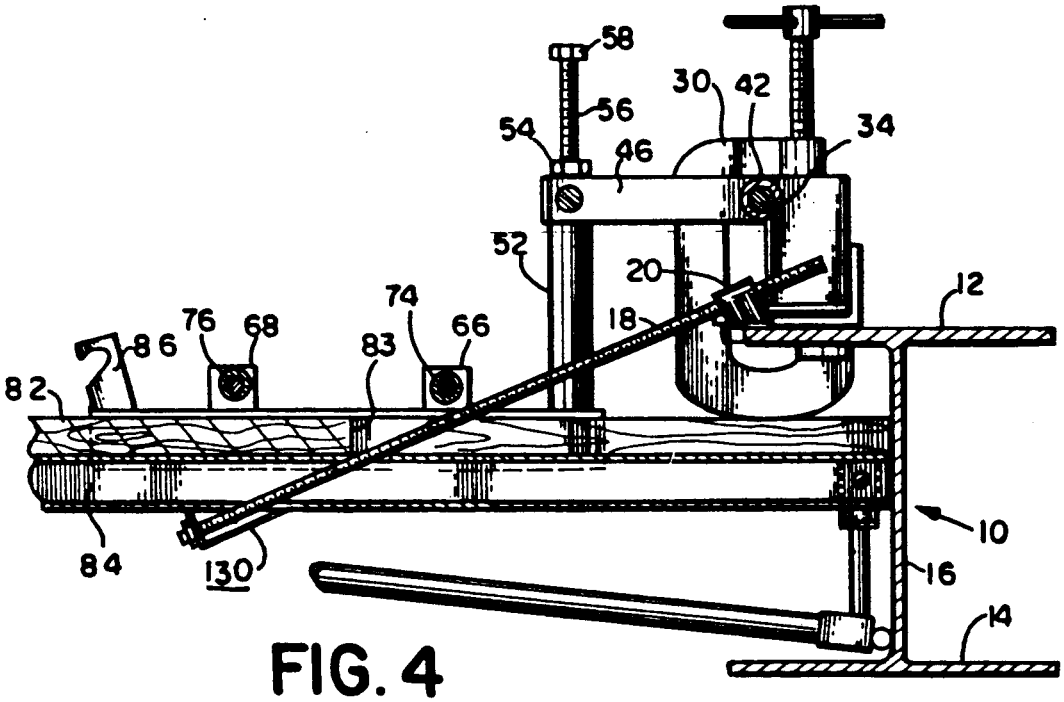
FIG. 4 is a sectional view taken on the line 4—4 in FIG. 2.

FIG. 1 illustrates the use of a jack hanging apparatus in attaching a jack to a rod that is anchored onto the top of a steel beam. The apparatus comprises a base and a holder which includes a receiver. The holder and receiver have been moved from a first location directly above the base, where a jack having a plank along the top of said jack is inserted into the receiver, to a second location at one side of the beam where the jack is attached to the structure by a rod.

In FIG. 1, a steel beam 10 includes an upper flange 12, a lower flange 14 and a web 16 connecting the flanges. A rod 18 is attached at one end to the upper side of the upper flange 12 at a nipple 20.

The base 24 of the apparatus 26 is mounted on the upper flange 12. In a preferred form, the base may be mounted on two runners or spacers (not shown) to elevate the base above the flange. This preferred form is used where the upper flange is uneven and does not provide a level surface on which the base may rest. The base 24 comprises a foot 28 which is in the form of an elongated angle iron with the lower leg clamped on top of the upper flange 12 (at 32) by means of two C-clamps 30 which also engage under the lower surface of the upper flange 12.

The C-clamps 30 are coupled to the foot 28 at 29 to maintain the elements of the base 24 assembled for easy handling. In another preferred form, a spacer may be inserted between the foot 28 and upper flange 12 to provide a firm seat for the foot 28 against the upper flange 12.

L-shaped members having vertical sections 36,38 are mounted on the base to support a pivot axle 34 which extends between said sections 36,38. The pivot axle 34 engages and supports a holder 40 having left and right side arms 45 and 46 through two metal sleeves 42 that encircle said axle 34. The sleeves 42 rotate on the pivot axle 34 when the holder 40 is manipulated between its selected locations. The sleeves 42 are movable along the pivot axle 34 to afford adjustment of the separation of the side arms 45 and 46, for example, when the holder's s receiver 44 engages or disengages the jack as described below. In addition, the sleeves 42 are movable together along the pivot axle to afford horizontal adjustment of the holder 40 to permit the jack to be accurately positioned along the length of the support. Each of the two sleeves 42 is attached along its outer circumference to a different one of two parallel side arms 45 and 46 mounted adjacent its first end.

A telescoping receptacle and sleeve guide 50, is mounted adjacent the opposite end of each of the two side arms to facilitate the adjustment of the arms 45 and 46.

Figures 2, 6:
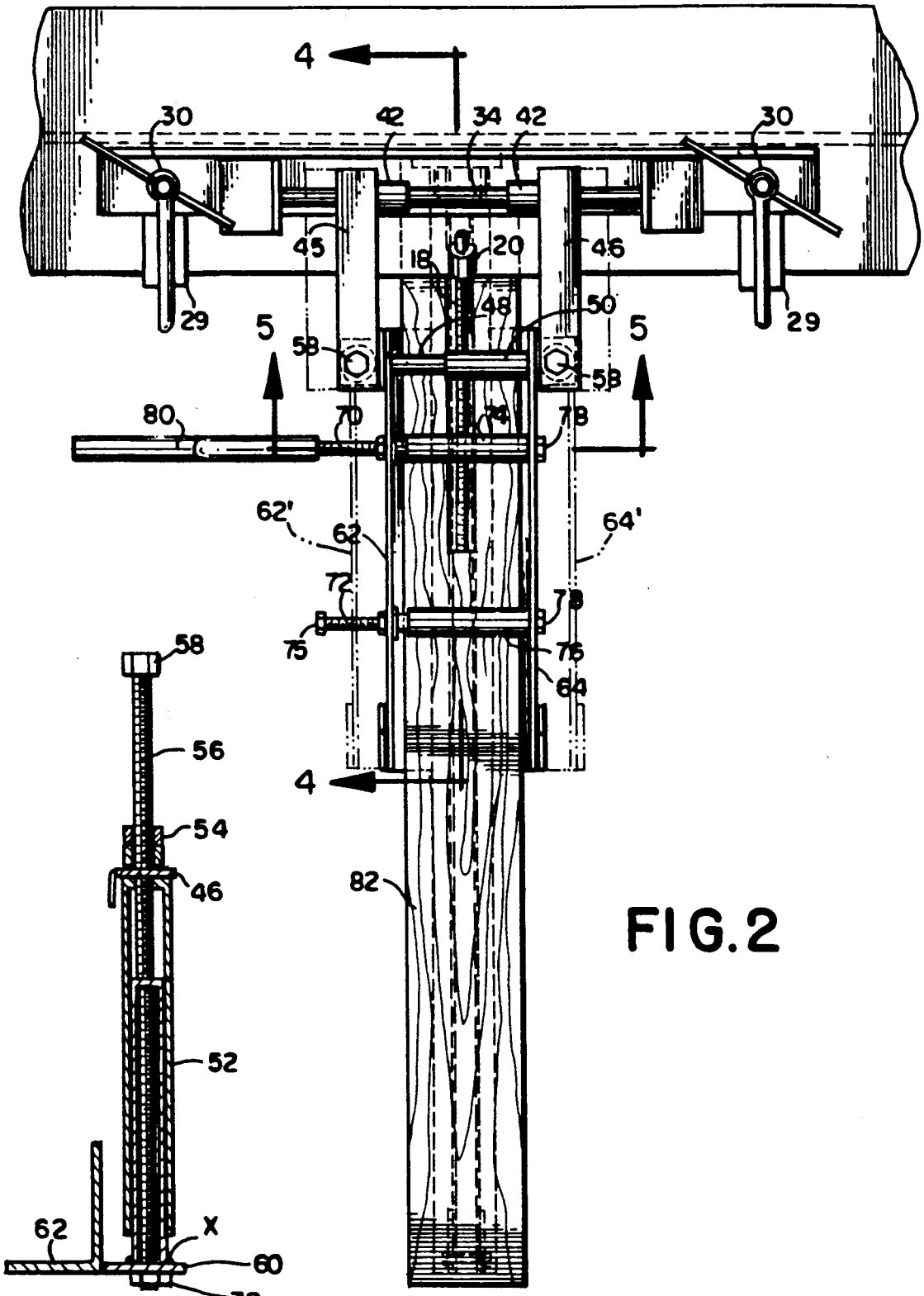
FIG. 2 is a plan view of the apparatus shown in FIG. 1 showing the jack in full lines.
FIG. 6 is a sectional view taken on the line 6—6 of FIG. 3.

As shown in FIG. 6, each of the two arms 45,46 also mounts a hollow receptacle 52 at the opposite end. Each receptacle 52 is mounted at substantially right angles to both the arm and the sleeve guide 50 and as shown in FIG. 1 has a threaded adjusting rod 56 and a locking nut 54 to cooperate with the threaded rod 56 and anchor it in place. The rod 56 has a head 58 at its upper end. Within the lower end of the receptacle 52 is a telescoping sleeve 57. The sleeve is attached to a metal plate 60. The sleeve 57 is moved in and out of the receptacle by rotation of the rod 56 in the threaded attachment below the locking nut 54. The rod 56 passes through sleeve 57 and is journalled in the plate 60 at its lower end. The sleeve 57 is anchored against axial movement in said metal plate 60 so that when said rod 56 is rotated, the sleeve moves and the vertical distance of the associated lower leg 62 or 64 of the holder 40 below the base 24 is adjusted.

Each of the metal plates 60 is attached respectively near a first end of parallel angle members 62,64 which form the left and right legs of a receiver 44. Angle member 62 has two vertical plates 66,68 each with a threaded opening. In each of these openings, a separate threaded rod 70,72 is inserted through each of said vertical plates 66,68 and is rotatable in telescoping sleeve and receptacle guides 74,76 projecting from the other angle member 64. Guide 74 is parallel to the guide 76 so that rotation of the rods 70 and 72 adjusts the separation of the left and right legs 62 and 64 of the receiver 44.

Figure 5:
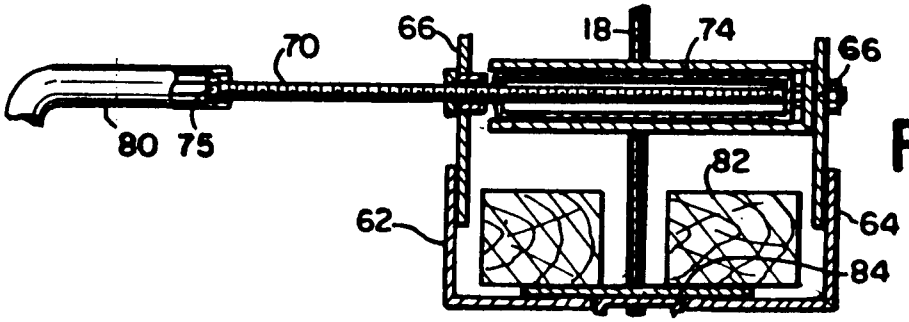
FIG. 5 is a fragmentary sectional view taken on the line 5—5 of FIG. 2.

The outer ends of the rods 70 and 72 have a head 75 which is slidably engaged with the inner surface of a hollow crank 80, as shown in FIG. 5. The extremity of the crank constitutes a handle 81 which rotates rods 70 and 72 to adjust the separation. It will be understood that the crank can be replaced by any tool able to effect rotation of the rods or bolts 70 and 72.

FIG. 1 shows the legs in a separated position whereas FIGS. 2 and 5 show the legs 62 and 64 closed against a jack assembly 84 in full lines, and separated in broken lines at 62' and 64'. In loading the jack hanging apparatus, the holder 40 is preferably rotated upwardly on the axle 34 to a first location shown in FIG. 7. When the holder 40 is in the first location, rods 70 and 72 are rotated to move the angle members 62,64 together to engage a jack 84. The angle members hold the jack 84 while the holder 40 is rocked downwardly to the second location shown in FIGS. 1-6, and the jack is attached to the support by the attachment rod 18. The rod 18 at its lower end passes through a slot 83 in the plank 82 and is secured to the jack by the fitting 130. At its upper end, the rod is anchored to the support by the nipple 20. After the jack is attached, rods 70 and 72 are rotated in an opposite direction to cause the angle members 62,64 to separate to disengage the angle members from the jack. After said disengagement, the holder is moved back to the first location.

Adjacent the second end of said angle members 62,64 hooks 86 are adapted to receive a handle 162 (FIGS. 7–10) which is used to manipulate the holder between the first and second locations.

Figure 3:
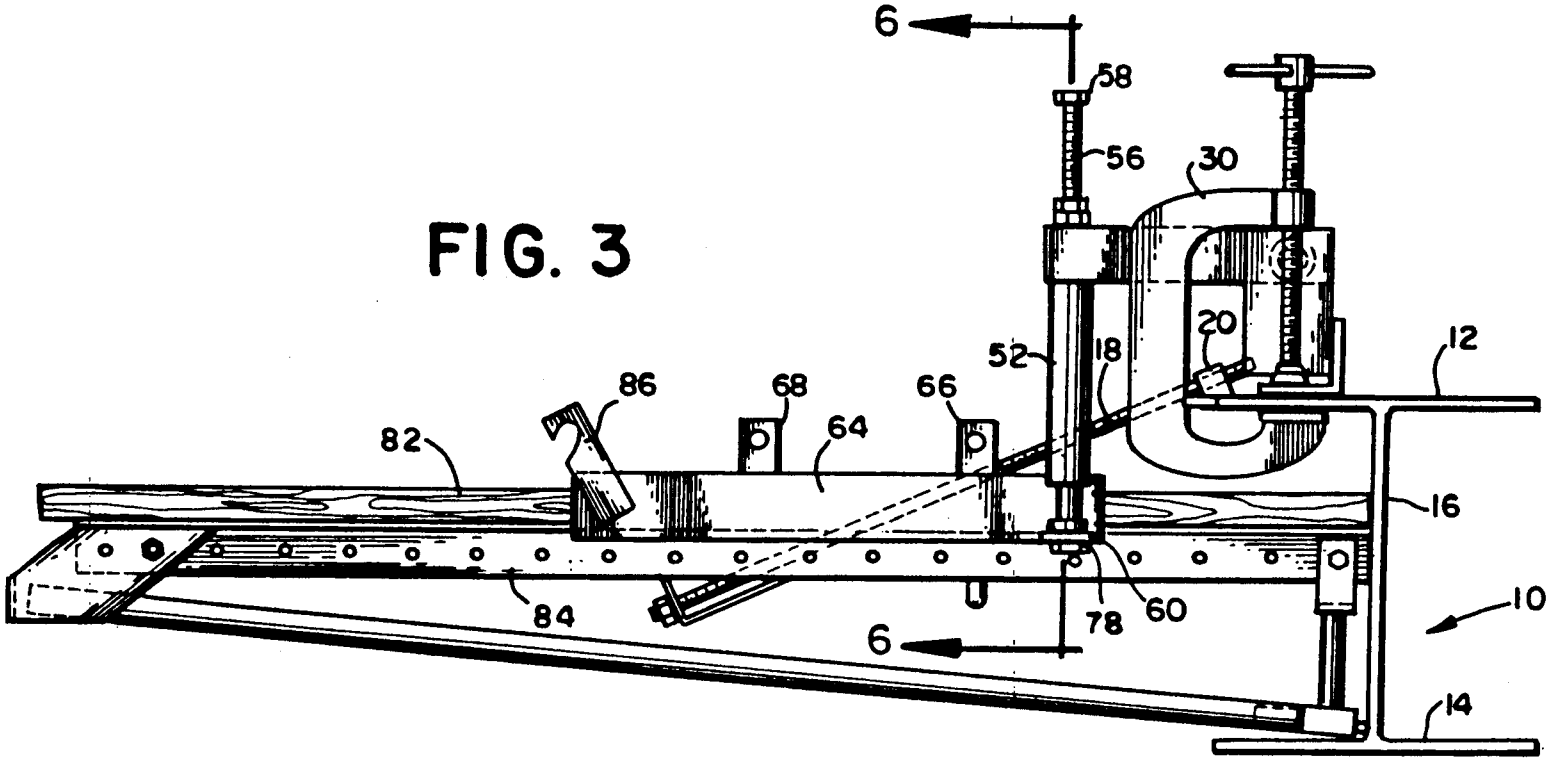
FIG. 3 is a side view of the apparatus and jack shown in FIG. 2.

FIG. 3 illustrates the jack 84 which comprises a triangular assembly. Although jacks typically have such an assembly, jacks may exist in other geometric forms, such as a rectangle. In a preferred embodiment, the plank 82 may be two or three feet longer than the horizontal portion of the jack 84 to which it is attached in order to provide more surface area for supporting a platform or for providing a broader area of support for concrete forms or molds and the concrete layer set in said forms or molds. The present apparatus may be used to attach a wide variety of jacks to beams, walls or other supports.

In addition, the apparatus may be used to attach a wide variety of articles to beams, walls or other supports as long as the article may be held by the apparatus. Some examples of such articles are wooden or aluminum beams, holders for tools or supplies, etc.

FIGS. 7 through 10 illustrate the movement of a holder of the apparatus shown in FIGS. 1–6 when the base 24 is mounted on a beam 10, holding a jack as the holder 40 is moved from the first to the second location.

Figure 7:
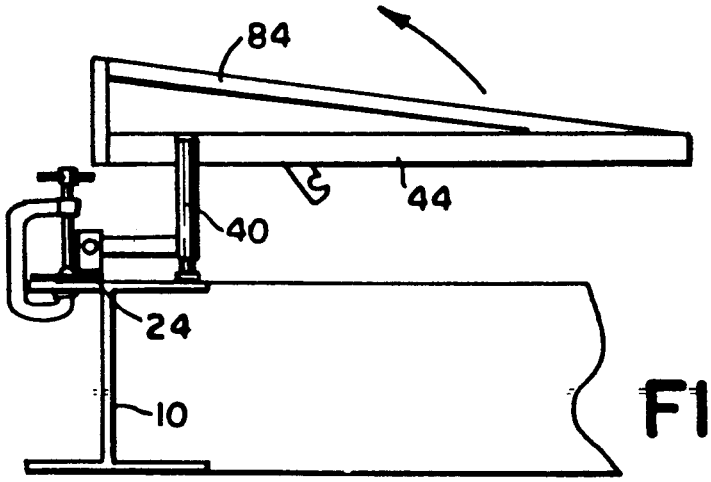
FIGS. 7 through 10 are diagrammatic side views illustrating the apparatus holding, rotating and positioning a jack at one side of a steel beam.

FIG. 7 shows the apparatus with the holder in the first location where it is convenient to insert a jack assembly 84 into the holder's receiver 44. The jack 84 is held as described above.

Figure 8:
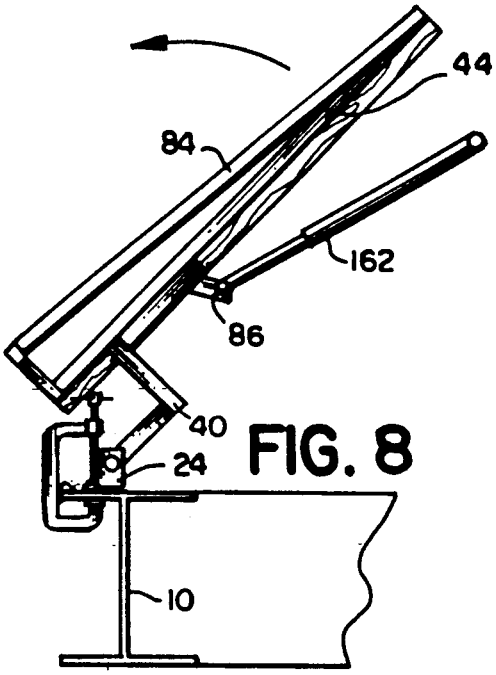

FIG. 8 shows the apparatus holding the jack 84 after the apparatus and jack have been moved by the handle 162 to an intermediate location above the beam. The handle 162 engages the holder hooks 86 which receive the distal end of the handle.

Figure 9:
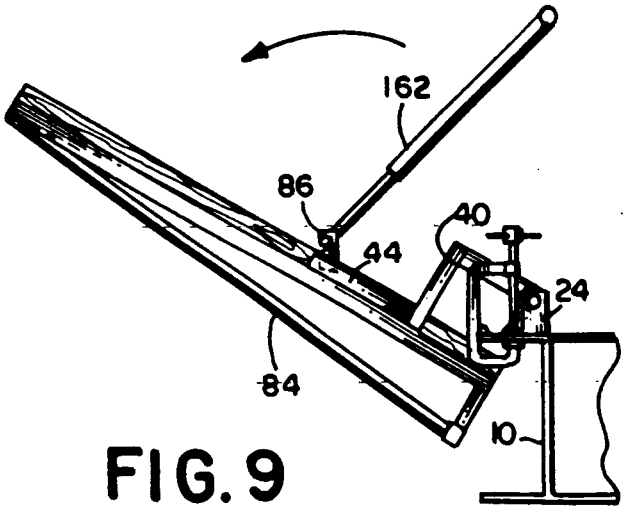

As shown in FIG. 9, the apparatus holding the jack 84 is manipulated by the handle towards a position that is closer to the second location substantially at the one side of the beam 10.

Figure 10:
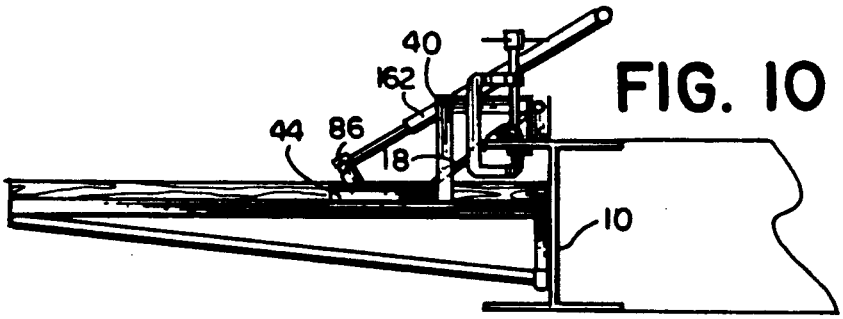

FIG. 10 shows the apparatus with the holder 40 in the second location holding a jack 84 at one side of a beam 10 for attaching the jack via rod 18 onto the beam 10. After the jack 84 has been attached, the angle members 62 and 64 are moved apart to disengage the receiver 44 from the jack assembly. Then, the holder 40 is raised back to the first location by the handle 162 and the apparatus is unclamped from the beam 10 for reuse at another location.

Figure 11:
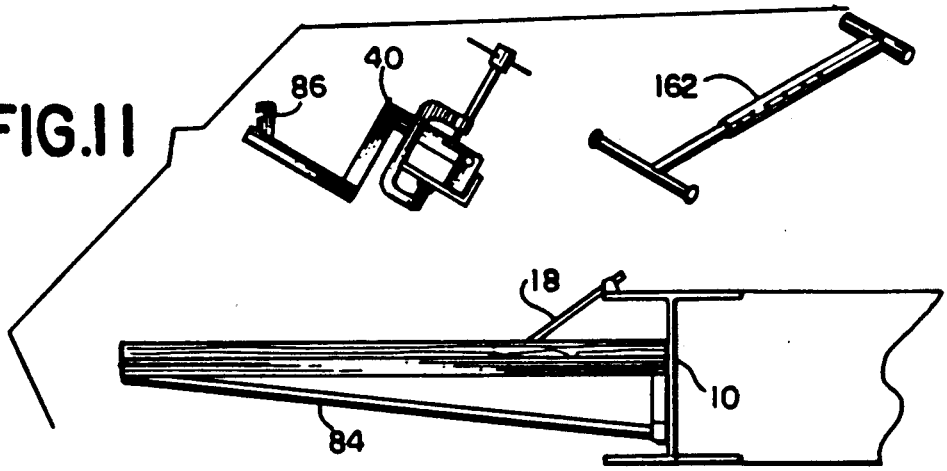
FIG. 11 is a diagrammatic view of the jack after it has been attached to the steel beam, including a fragmentary illustration of the apparatus as it is removed from its operative position, and a detached perspective view of a handle used to manipulate the apparatus.

FIG. 11 shows a jack 84 after it has been attached to the beam 10 and an apparatus after said apparatus has been removed from the beam 10. FIG. 11 also shows a T-bar handle 162 used to manipulate the holder 40 between the aforementioned first and second locations. While the handle 162 is shown in the form of a T-bar, the rod may have other configurations or other tools may be used to move the holder between the first and second locations.

The apparatus referred to above has been described in connection with its use for attaching a jack by a rod that is mounted on a steel beam. As noted above, jacks are also attached in a similar manner to free-standing and retaining walls and to other types of structural supports such as concrete beams and to larger fabricated structures such as steel substructures for bridges. The apparatus described herein can be used to mount jacks to the side of free-standing walls and to other types of support structures if relatively minor modifications are made to the base of the apparatus in order to anchor the apparatus securely to said wall or support.

Figure 12:
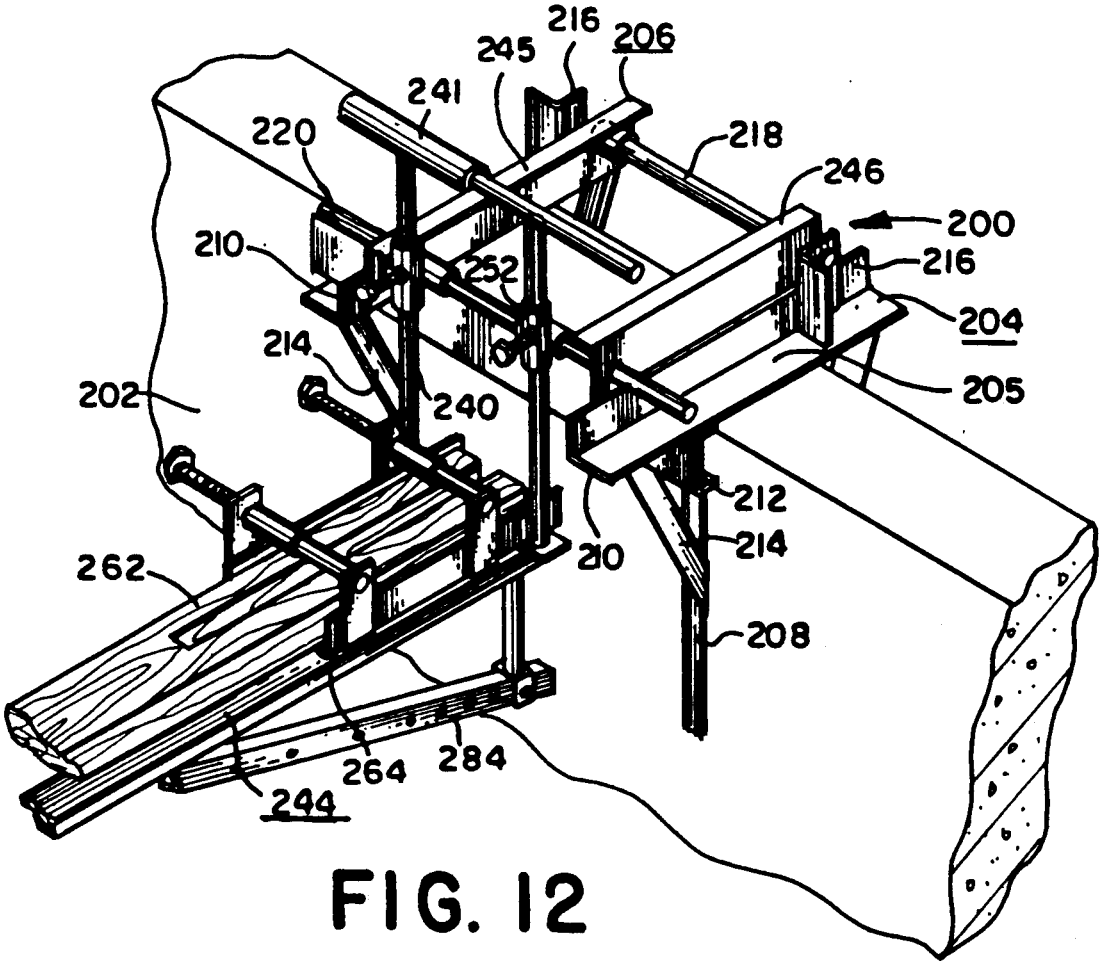
FIG. 12 is a view in perspective showing a second embodiment of the apparatus of the present invention holding a jack positioned at one side of a wall.
Figure 13:
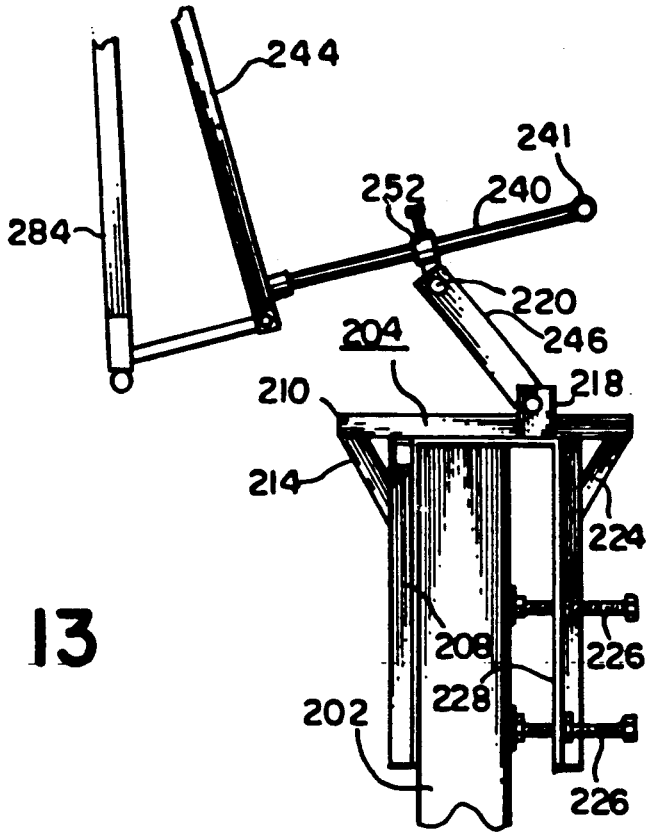
FIG. 13 is a diagrammatic view of the apparatus of FIG. 12 showing the placement of a jack at one side of a wall.

FIGS. 12 and 13 illustrate an apparatus 200 adapted for use on a free-standing wall 202. The base 204 of the apparatus 200 comprises a saddle frame having a rectangular top 205 which seats on the top of the wall 202 and is adapted to be anchored to the top of the wall 202. The top 206 has two transverse cross pieces 210 resting on top of the wall and a longitudinal front piece 212 mounted to confront the jack side of the wall. Metallic braces 214 connect depending legs 208 to the cross pieces to provide a stable support. Corresponding legs 228 depend from the back of the cross pieces 210 and are braced at 224 to confront the opposite side of the wall. Clamping screws 226 are engaged in the legs 228 to timely clamp the base 204 against the jack side of the wall 202.

The cross pieces 210 of the assembly mount upstanding feet 216 which support a bar 218 therebetween. The bar 218 is a pivot axle for the holder 206 comparable to the pivot axle 34 for the holder 40 shown and described in connection with FIG. 1.

The holder 206 illustrated in FIG. 12 is comparable to the holder 40 described in connection with FIG. 1. However, the holder 206 is articulated and has an additional axle 220 above the depending legs 208. The pivot axle 220 extends between and beyond the angle members 245 and 246 which form the top of the holder 206, so that the ends of the pivot axle 220 bear against the tops of the cross pieces 210 and provide a limit stop for the pivotal movement of the angle members 245 and 246 of the holder 206 on the axle 218.

A receiver 244 designed to engage a jack 284 is vertically adjustable on the angle members 245 and 246 by upstanding rods 240 which are adjustably secured to the axle 220 as shown in 252. The rods 240 are interconnected at their tops by a telescoping handle which facilitates vertical adjustment of the rods and also may be used to rock the receiver 244 between the lowered position shown in FIG. 12, and elevated positions, for example the position shown in FIG. 13. If desired, the receiver 244 may also have hooks similar to the hooks 86 of the receiver 44 to receive the handle 162. The receiver has means to adjust the separation of its legs similarly to the adjustment of the legs 62 and 64 to receive and retain the jack 284 therebetween. The additional pivot axle 220 provides greater facility in adjusting the height of the rods 240. As in the apparatus shown in FIG. 1, an adjustment of the rods 240 produces an adjustment in the vertical distance of the holder below the base 204 of the apparatus. This greater flexibility is desirable in attaching jacks 284 to a wall as the top surface of the wall may vary in height. Preferably, the rods 240 have indicia, as shown in FIG. 13 to add in achieving proper adjustment of the receiver 244.

Figure 14:
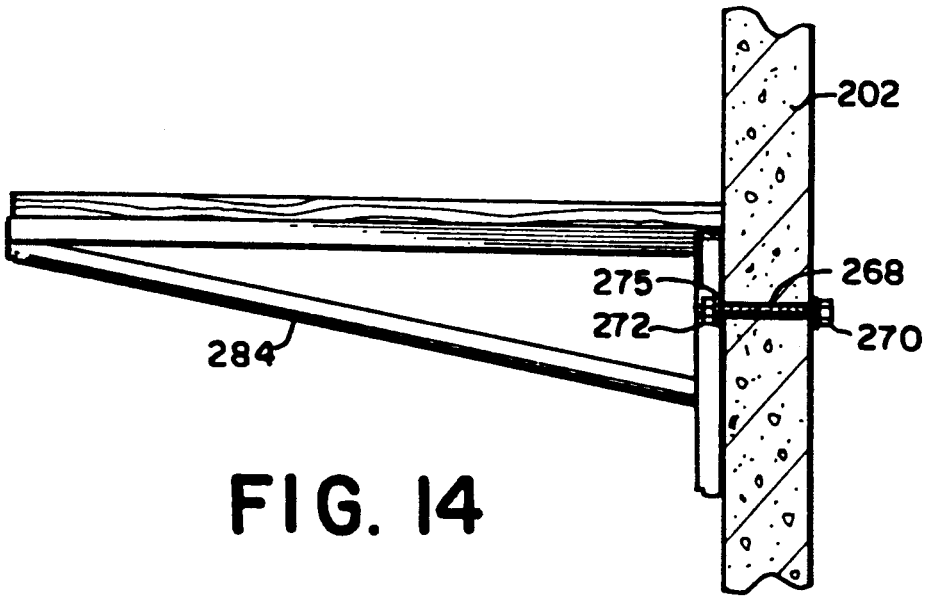
FIG. 14 is a side view showing the attachment of the jack to a wall.

As shown in FIG. 14, in one method of attaching the jack 284 to the wall 202, a hole is drilled through the wall and a bolt 268 is inserted through the hole, with the head 270 of the bolt 268 on the side opposite the jack 284. The jack 284 is mounted by the bolt 268 and a nut 272 passing through a mounting aperature 275 in the jack to prevent the jack 284 from falling off the wall 202. As an alternative, the bolt 268 is inserted only partially through the concrete wall 202.

To facilitate this method of attaching the jack to the wall, a drill is provided to engage in the receiver 244 so that the axis of the drill bit when mounted in the receiver coincides with the axis of the mounting aperature 275 when the jack 284 is mounted in the receiver. The drill is positioned in the receiver and is swung downwardly into position against the wall and the drill is advanced to drill the appropriate hole in the wall for receiving the bolt. After drilling the hole, the receiver and holder are pivoted upwardly and the drill is removed from the receiver and, without changing the adjustment of the height of the receiver on the holder, the jack is mounted in the receiver and the articulated holder is moved back into the second position for positioning the jack in alignment so that its aperature 275 is aligned with the hole made by the drill. The bolt is then inserted through the hole and the aperature and secured in place. Instead of the bolt, a threaded rod may be used with a nut serving the function of the head 270. By mounting the drill on the same receiver that is used to position the jack against the wall, there is assurance that the hole drilled in the wall will align with the aperature of the jack.

After the jack 284 has been attached, the holder is disengaged from the jack 284. Then the holder is moved back to the first location and the base 204 of the apparatus is then unclamped from the wall 202 leaving the result shown in FIG. 14.

Figure 15:
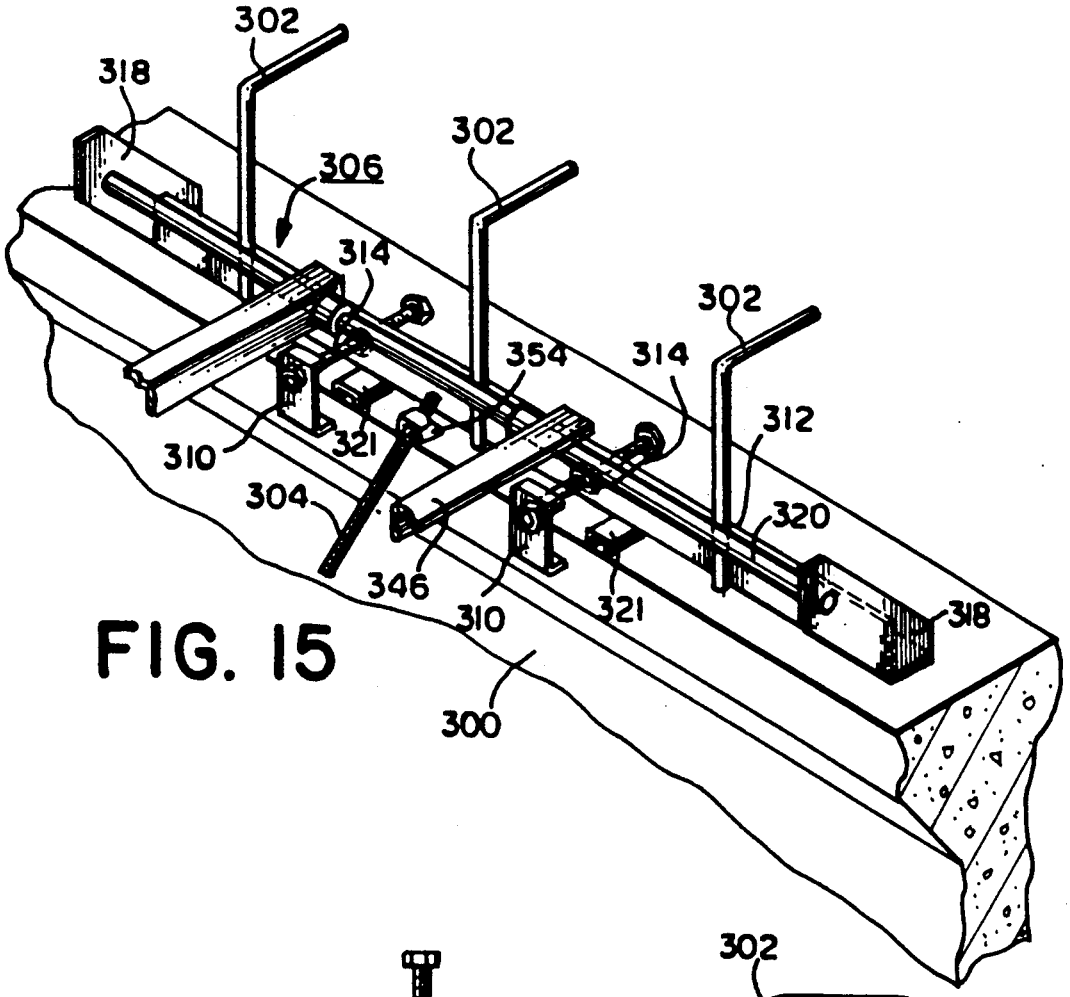
FIG. 15 is a fragmentary perspective view showing the base of a third embodiment of apparatus used for mounting a jack on the side of a concrete beam.
Figure 16:
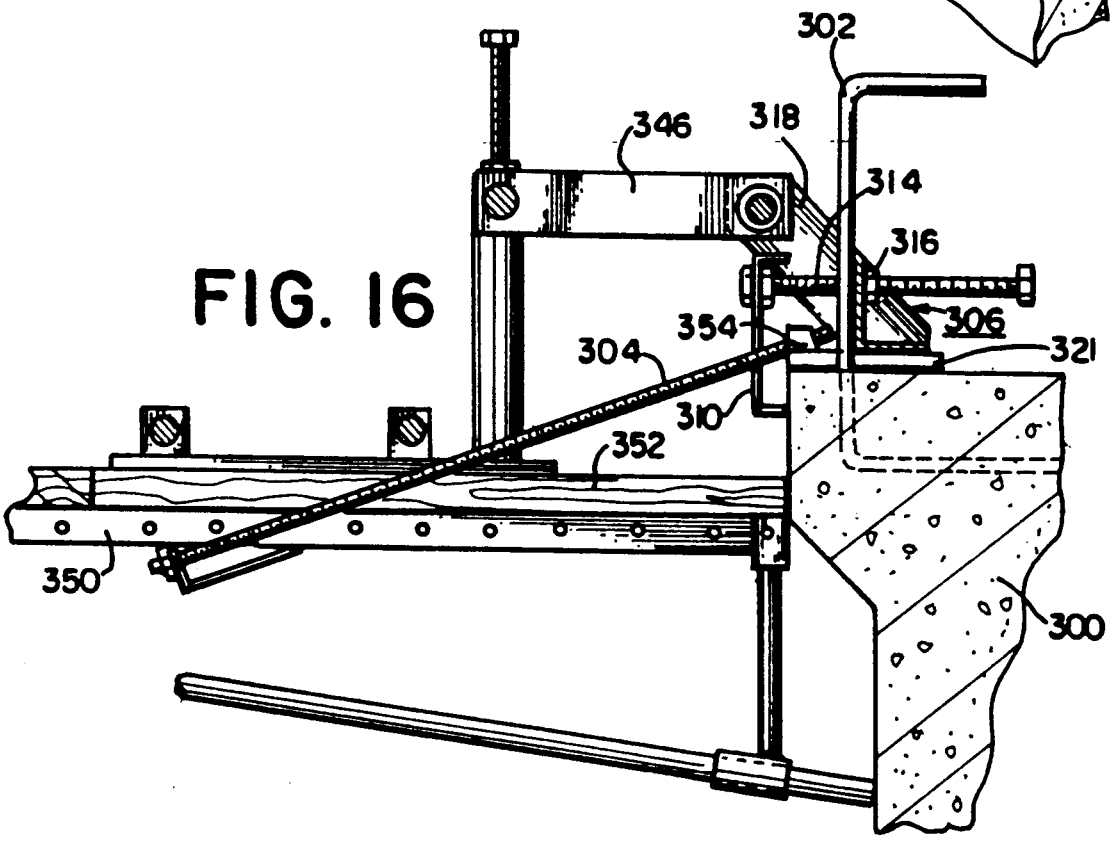
FIG. 16 is a side view of the third embodiment of apparatus with the receiver at the side of the beam and a jack attached to the side of a concrete beam.

FIGS. 15 and 16 show an alternate form of base 306 for a jack hanging apparatus that is adapted for use along the edge of a concrete structural support which is not configured to receive the base 24 or the base 204. The concrete structural support 300 in FIGS. 15 and 16 contains at fixed intervals along the support rebars 302 buried in the concrete support and having one end projecting upwardly above the support. The concrete support 300 also has nipples 354 that are attached by poured concrete at fixed intervals on the upper surface of the support to receive rods 304 for supporting the jacks 350.

As shown in FIG. 15, the base 306 comprises a rigid member 312 that is braced behind the projecting ends of the rebars, fittings 310 against the one side of the concrete support 300 and bolts 314 which pass through an opening in each of the two fittings 310 and through openings in the rigid member 312. Lock nuts 316 engage the end portions of rods 314 and press against the nonconfronting sides of the fittings 310 and rigid member 312 to clamp said fittings 310 against the support 300 and rigid member 312 against the rebars 302. The rigid member 312 includes two upstanding supports 318 which project upwardly and forwardly to support an axle bar 320 directly above the fittings 310. The bar 320 is a pivot axle like the axle 34 shown in FIG. 1 and on which a holder 346 is pivotally mounted for movement between the first and second locations as described in connection with the holder 40 of FIG. 1.

It will be readily appreciated that the base 306 shown in FIGS. 15 and 16 may be adapted to be anchored along the edge of any type of other surface that has a top and side, such as a deck. The base 306 may be anchored to any top surface by weights or may be attached to the surface by screws or other means. The fixtures shown in FIG. 15 may be used to clamp against the exposed side of the deck or other surface and thereby aid in supporting the base.

As shown in FIG. 16, the base 306 supports the holder 346 holding a jack 350 having a wooden plank 352 while the holder is positioned in the second location at the side of a concrete structural support. The jack 350 is mounted on the rod 304 which is attached to the nipple 354 mounted onto the support 300. To provide a firm seat for the base 306, tranverse runners 321 are provided at spaced points along its length, preferably adjacent the fittings 310, to support the base on the upper surface of the structure.

While particular embodiments of the present invention have been herein illustrated and described, it is not intended to limit the invention to such disclosure but changes and modifications may be made thereon and thereto within the scope of the following claims.

We claim:

1. An apparatus for holding, rotating and positioning a jack for the purpose of attaching said jack to one side of a structural support, said apparatus comprising:

(a) a base having means to mount the base on the structural support and including a pivot axle extending parallel to said one side of said structural support; and (b) a holder pivotally connected at one end to the pivot axle of the base, such holder having at least two side arms connected to said axle for adjustment of said arms relative to each other along the axle between closed and open positions, and for displacement of the holder between a first location above said structural support and a second location at said one side, each of said arms having a receiver, said receivers operable in said closed position to engage and retain the jack as the holder is pivoted between said locations in order to position the jack for attachment to said one side of the structural support, said receivers in the open position affording disengagement of the holder from the jack after said attachment, in said open position, said holder being displacable from said second location back to said first location after disengagement of the holder from the jack.

2. An apparatus as set forth in claim 1 wherein the base mounting means comprises releasable clamps adapted to afford removal of the base from the structural support after the removal of the jack from the holder.

3. An apparatus as set forth in claim 1 comprising a handle and means to attach the handle to the end of the holder opposite said one end so as to enable the displacement of the holder between the two locations by the use of said handle.

4. An apparatus as set forth in claim 1 wherein the structural support is a steel I-beam and the base mounting means comprises two C-clamps operable to clamp the base to the support.

5. An apparatus as set forth in claim 1 wherein the holder comprises means for moving the receivers together to the closed position to engage and retain he jack therebetween and apart to the open position to disengage the jack.

6. An apparatus as set forth in claim 1 wherein the base comprises a longitudinal angle member having transverse runners at spaced points along the length of the angle member underneath its lower surface to support the base on the upper surface of the structural support.

7. An apparatus as set forth in claim 1 wherein the two side arms are connected to the base by sleeves at said one end and have a guide adjacent the opposite end spanning between said arms and said receivers, said guide having means of adjusting the distance of the receivers from the base.

8. An apparatus as set forth in claim 1 wherein the base includes a pair of upstanding supports having said pivot axle extending therebetween parallel to said one side of said structural support.

9. An apparatus for holding, rotating and positioning a jack for the purpose of attaching said jack to one side of a structural support, said apparatus comprising:

(a) a base anchored on the top of the support and braced against said one side and having a generally horizontal rigid member positioned above the support; and (b) a holder pivotally connected at one end to said rigid member by two side arms pivotally connected to said rigid member for horizontal adjustment of said arms relative to each other along the rigid member between closed and open positions and for displacement of the holder between a first location above said support and a second location at said one side, said holder having a receiver for each arm operable in a closed position of the arms to retain the jack as the holder is pivoted between said locations in order to position the jack for attachment to said one side of the support, said receivers operable in the open position of the arms affording disengagement of the holder from the jack after said attachment, in said open position, said holder being displacable from said second location back to said first location after disengagement of the holder from the jack.

10. An apparatus as set forth in claim 9 comprising a handle and means to attach the handle to the holder at the end opposite said one end so as to enable the displacement of the holder between the two locations by the use of said handle.

11. An apparatus as set forth in claim 9 wherein the receivers comprise two parallel members and means for moving the members together to a closed position to engage and retain the jack therebetween and apart to an open position to disengage the jack.

12. An apparatus as set forth in claim 9 wherein the base comprises a longitudinal angle member having transverse runners at spaced points along the length of the angle member underneath its lower surface to support the base on the upper surface of the structural support.

13. An apparatus as set forth in claim 9 wherein the holder side arms are connected to the rigid member by sleeves at said one end and have a guide adjacent the opposite end spanning between said arms and said receivers, said holder having means for adjusting the distance of the receivers from the base.

14. An apparatus for holding, rotating and positioning a jack for the purpose of attaching said jack to one side of a concrete structural support having reinforcing rods that project upwardly from the support and having front portions directed toward said one side, said apparatus comprising:

(a) a base mounted on top of said support and having means for clamping said base against the rear portions of the rods opposite to said front portions above the concrete support and including a generally horizontal pivot axle extending parallel to said one side of said structural support; and (b) a holder having two side arms pivotally connected at one end to the pivot axle of the base for horizontal adjustment of said arms relative to each other between closed and open positions along the axle and for displacement of the holder between a first location above said structural support and a second location at said one side, each of said arms having a receiver, said receivers operable in said closed position to engage and retain the jack as the holder is pivoted between said locations in order to position the jack for attachment of the jack to said one side of the concrete support, said receivers in the open position affording disengagement of the holder from the jack after said attachment; in said open position, said holder being displacable from said second location back to said first location after disengagement of the holder from the jack.

15. An apparatus as set forth in claim 14 comprising a handle and means to attach the handle to the holder at the end opposite to said one end so as to enable the displacement of the holder between the two locations by the use of said handle.

16. An apparatus as set forth in claim 14 wherein the receivers comprise two parallel members and means for moving the members together with said arms to a closed position, to engage and retain the jack therebetween and apart with said arms to an open position to disengage the jack.

17. An apparatus as set forth in claim 14 wherein the base comprises a longitudinal angle member having transverse runners at spaced points along the length of the angle member underneath its lower surface to support the base on the upper surface of the structural support.

18. An apparatus as set forth in claim 14 wherein the two side arms are connected to the axle at one end and have a guide adjacent the opposite end spanning between said arms and said receiver, said holder having means of adjusting the distance of the receivers from the base.

19. An apparatus for holding, rotating and positioning a jack having a topside providing a support structure and an underside providing a strut portion for the purpose of attaching said jack to one of two opposite sides of a wall with the support structure uppermost and the strut posited below the support structure and angled against the wall, said apparatus comprising:

(a) a saddle frame anchored on the wall, confronting both sides of the wall, and clamped against said one side; and (b) a holder pivotally connected at one end to the saddle frame for displacement between a first location above said saddleframe and a second location at said one side, said holder having a pair of elongated receiver members and an actuator to displace said members relative to each other to a closed position to releasably engage the jack from the topside when in the first location, and operable to retain the jack as the holder is pivoted between said locations in said second location said receiver members being constructed and arranged to position the jack for attachment of the strut portion on its underside to one side of the wall, said receiver members being actuatable relative to each other to an open position for disengagement of the holder from the jack after said attachment; in said open position, said holder being displacable from said second location back to said first location after disengagement of the jack from the holder.

20. An apparatus according to claim 19 wherein said holder is articulated, having a top pivotally connected at one end to said saddle frame adjacent the side of the wall opposite to said one side, said top having a second end extending in said second location to overlie said one side, said receiver members being pivoted to said top at said second end, said pivots having parallel pivot axes.

21. An apparatus as set forth in claim 19 wherein the receiver members comprise two parallel angle members.

22. An apparatus as set forth in claim 19 wherein the saddle frame comprises a longitudinal angle member having transverse runners at spaced points along the length of the angle member underneath its lower surface to support the saddle frame on the upper surface of the structural support.

23. An apparatus as set forth in claim 19 wherein the holder includes a top pivotally connected to the saddle frame by sleeves at said one end and pivotally connected to a pivot axle at the opposite end, said holder also having two parallel rods pivotally connected to said pivot axle adjacent the opposite end, the rods spanning between said top and said receiver members, said rods having means of adjusting the distance of the receiver members from the saddle frame.

24. An apparatus for holding, rotating and positioning a jack for the purpose of attaching said jack to one of two sides of a wall, said apparatus comprising:

(a) a frame releaseably anchored on the wall having a pivot axle extending parallel to said one side of said wall; and (b) a holder having two angle members pivotally connected at one end to sleeves mounted on the pivot axle for providing horizontal adjustment of said angle members relative to each other along the axle between closed and open positions and vertical pivotal displacement of said holder between a first location above said wall and a second location at said one side to position the jack for attachment to said one side of the wall, said holder having a receiver mounted to an opposite end of each angle member operable in the closed position to retain the jack when the holder is pivoted between said locations, said receiver being actuatable to the open position for removal of the holder from the jack after said attachment; in said open position, said holder being displacable from said second location back to said first location after disengagement of the jack from the holder.

25. An apparatus for holding, rotating and positioning a jack for the purpose of attaching said jack to one side of a structural support, said apparatus comprising:

(a) a base having means to releasably clamp the base on the structural support; and (b) a holder pivotally connected at one end to the base for displacement between a first location above said base and a second location at said one side to position the jack for attachment to said one side of the structural support, said holder having a receiver comprising two parallel elongated angle members and adjusting means operable for moving the elongated members together to a closed position to engage and retain the jack when the holder is pivotally displaced between said locations, said adjusting means also operable for moving the two elongated members apart to an open position to disengage the holder from the jack after said attachment; in said open position, said holder being displacable from said second location back to said first location after disengagement of the jack from the holder.

26. An apparatus for holding, rotating, and positioning a jack for the purpose of attaching said jack to one side of a structural support, said apparatus comprising:

(a) a base having means to releasably clamp the base on the structural support; and (b) a holder comprising two side arms, and a receiver mounted on an end of each arm, said side arms being pivotally connected at an opposite end to eh base for displacement of the holder between a first location above said structural support and a second location at said one side to position the jack for attachment to said one side of the structural support, said side arms being displaceable relative to each other along the pivot axis between closed and open positions, and means connecting said side arms and the receivers for adjusting the distance of the receivers from the arms, said receivers being operable in said closed position to retain the jack when the holder is pivoted between said locations, said receivers being actuatable to said open position for removal of the holder from the jack after said attachment; in said open position, said holder being displacable from said second location back to said first location after disengagement of the jack from the holder.

* * * * *